US012448873B1

(12) United States Patent
Jones et al.

(10) Patent No.: US 12,448,873 B1
(45) Date of Patent: Oct. 21, 2025

(54) PUDDLE JOB WITH DELAYED SETTING OF RESIN

(71) Applicant: Halliburton Energy Services, Inc., Houston, TX (US)

(72) Inventors: Paul J. Jones, Houston, TX (US); Ernst Rudolf Man Schnell, Houston, TX (US); Lonnie Carl Helms, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/735,390

(22) Filed: Jun. 6, 2024

(51) Int. Cl.
*E21B 43/10* (2006.01)

(52) U.S. Cl.
CPC ..... *E21B 43/10* (2013.01); *E21B 2200/04* (2020.05)

(58) Field of Classification Search
CPC ..... E21B 43/10; E21B 2200/04
See application file for complete search history.

(56) References Cited

U.S. PATENT DOCUMENTS

| | | | | |
|---|---|---|---|---|
| 4,972,906 | A * | 11/1990 | McDaniel | E21B 43/14 166/313 |
| 9,617,830 | B2 | 4/2017 | Minassa et al. | |
| 10,072,479 | B2 | 9/2018 | Felten et al. | |
| 11,982,149 | B2 | 5/2024 | Burguieres | |
| 2014/0174741 | A1 * | 6/2014 | Agapiou | E21B 33/14 166/206 |
| 2017/0259977 | A1 | 9/2017 | Hall et al. | |

* cited by examiner

*Primary Examiner* — James G Sayre
(74) *Attorney, Agent, or Firm* — Sheri Higgins Law, PLLC; Sheri Higgins

(57) ABSTRACT

A puddle job can be performed in a wellbore to secure a liner within an open-hole wellbore. A resin in liquid form can be spotted at the bottom of the wellbore. The liner can be lowered into the wellbore to displace the resin up into an annulus between the outside of the liner and the wellbore wall. The resin can be contacted with a solid or liquid initiator to cause the resin to set. The resin can be contacted with the initiator as the liner is being lowered or afterwards. The resin/initiator can be used instead of a cement composition.

20 Claims, 5 Drawing Sheets

PUDDLE JOB WITH DELAYED SETTING OF RESIN

TECHNICAL FIELD

The field relates to a puddle job for oil or gas operations using a settable resin instead of cement. The resin can set when contacted with an initiator. The contact with the initiator can be delayed.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
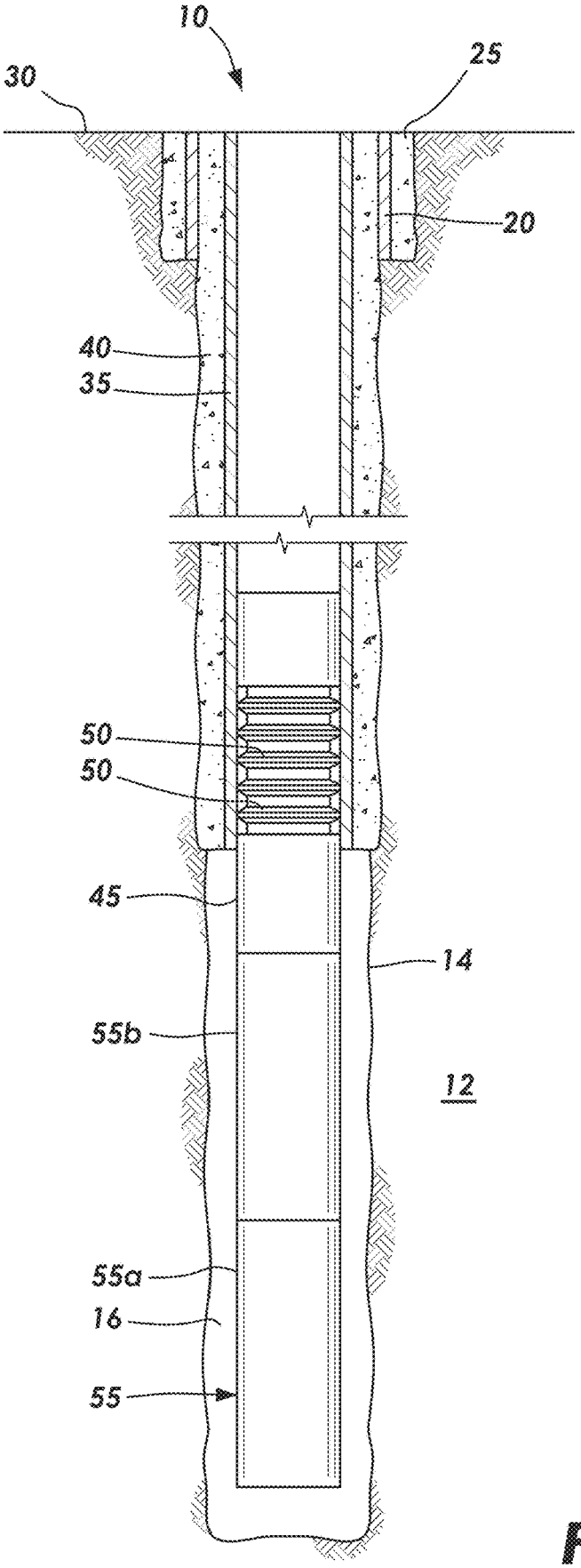
FIG. 1 is a schematic illustration showing a wellbore having a surface casing and a liner suspended from the surface casing via a liner hanger according to certain embodiments.

Oil and gas hydrocarbons are naturally occurring in some subterranean formations. In the oil and gas industry, a subterranean formation containing oil and/or gas is referred to as a reservoir. A reservoir can be located under land or offshore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from a reservoir is called a reservoir fluid.

As used herein, a "fluid" is a substance having a continuous phase that can flow and conform to the outline of its container when the substance is tested at a temperature of 71° F. (22° C.) and at a pressure of one atmosphere "atm" (0.1 megapascals "MPa"). A fluid can be a liquid or gas. A homogenous fluid has only one phase; whereas a heterogeneous fluid has more than one distinct phase. A colloid is an example of a heterogeneous fluid. A heterogeneous fluid can be a slurry, which includes a continuous liquid phase and undissolved solid particles as the dispersed phase; an emulsion, which includes a continuous liquid phase and at least one dispersed phase of immiscible liquid droplets; a foam, which includes a continuous liquid phase and a gas as the dispersed phase; or a mist, which includes a continuous gas phase and liquid droplets as the dispersed phase. As used herein, the term "base fluid" means the solvent of a solution or the continuous phase of a heterogeneous fluid and is the liquid that is in the greatest percentage by volume of a treatment fluid.

A well can include, without limitation, an oil, gas, or water production well, an injection well, or a geothermal well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet radially of the wellbore. As used herein, "into a subterranean formation" means and includes into any portion of the well, including into the wellbore, into the near-wellbore region via the wellbore, or into the subterranean formation via the wellbore.

A wellbore is formed using a drill bit. A drill string can be used to aid the drill bit in drilling into the subterranean formation to form the wellbore. The drill string can include a drilling pipe. During drilling operations, a drilling fluid, sometimes referred to as a drilling mud, may be circulated downwardly through the drilling pipe, and back up an annulus between the wellbore and the outside of the drilling pipe. The drilling fluid performs various functions, such as cooling the drill bit, maintaining the desired pressure in the well, and carrying drill cuttings upwardly through the annulus between the wall of the wellbore and the drilling pipe.

A portion of a wellbore can be an open hole or cased hole. In an open-hole wellbore portion, a tubing string can be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include but are not limited to the space between the wall of a wellbore and the outside of a tubing string in an open-hole wellbore; the space between the wall of the wellbore and the outside of a casing in a cased-hole wellbore; and the space between the inside of a casing and the outside of a tubing string in a cased-hole wellbore.

FIG. 1 shows an example of a wellbore 10 having casing and a liner hanger 45 and joints of liner 55. A joint of liner can also be called a pipe section. A pipe joint, for example a liner joint, is a section of pipe connected to the next section or joint by a union or connector. The wellbore 10 can penetrate a subterranean formation 12 and has a wellbore wall 14. Surface casing 20 can extend from the surface 30 into the wellbore 10 down to a desired depth. Multiple joints of surface casing 20 joined together can be used. A cement sheath 25 can anchor the surface casing 20 in the wellbore 10. Optionally, an intermediate casing 35 can be deployed concentrically within the surface casing 20. The intermediate casing 35, when used, can be held in place within the surface casing 20 with an intermediate cement sheath 40. Multiple joints of intermediate casings 35 can be used. A liner hanger 45 can be deployed within the intermediate casing 35 or within the surface casing 20 if intermediate casing is not used. The liner hanger 45 can suspend a liner 55 from its end. Multiple joints of liner 55 can be run into the wellbore 10. An annulus 16 can be located between the outside of the liner 55 and the inside of the wellbore wall 14. The liner hanger 45 can be anchored to the intermediate casing 35 or surface casing 20 and can include one or more sealing elements 50 that form an integral part of the liner hanger 45 or can sit on top of the liner hanger 45 as a standalone packer element. The sealing elements 50 can seal an annulus located between the outside of an inner intermediate casing and the inside of the adjacent intermediate casing. The seal can inhibit or prevent wellbore fluids from bypassing the liner 55 and liner hanger 45.

During well completion, it is common to introduce a cement composition into the annulus 16 in order to cement the liner 55 in the wellbore 10. By cementing the liner 55 in the wellbore 10, fluids are prevented from flowing into the annulus 16. Consequently, oil, gas, or water can be produced in a controlled manner by directing the flow of formation fluids through the liner 55 and casing 20/35 and into the wellhead. Liner cementing generally involves pumping a cement composition through the surface casing, liner hanger, and the liner out the bottom of the liner and up into the annulus. During the cementing operation, the cement is pumped through tight clearances, for example, in the liner hanger, a float shoe, or float equipment. Pumping pressure may need to be increased to force the cement past these tight clearances. However, there is a risk that the equivalent circulating density (ECD) increases to such an extent that one or more joints of the liner can collapse and/or there is an increased risk that the cement fractures the subterranean formation. If fracturing occurs, then some of the cement can be lost into the formation instead of remaining in the annulus, which causes an incomplete cementing job.

To overcome these risks, a puddle job can be performed instead in vertical wellbores. A puddle job typically involves one of 2 different operations. One is to run a smaller string into the wellbore to pump the cement into the bottom of the wellbore, pull the smaller string from the wellbore, and then run the last joints of liner into the wellbore. Another is to run all but the last joint of liner into the wellbore, then pump cement into the wellbore, and then run the last joint of liner into the wellbore. When the last liner joint(s) are run into the wellbore, the bottommost joint contacts and displaces the puddle of cement residing at the bottom of the wellbore. As used herein, the term "bottom" and all grammatical variations thereof means at a location farthest from the wellhead. The bottommost joint of liner can include float equipment or valves that prevent the cement from entering the inside of the liner; and therefore, forces the cement up into the annulus on the outside of the liner.

As used herein, a "cement composition" is a mixture of at least cement and water. A cement composition can include additives. As used herein, the term "cement" means an initially dry substance that develops compressive strength or sets in the presence of water. Some examples of cements include, but are not limited to, Portland cements, pozzolanic cements, gypsum cements, high alumina content cements, slag cements, high magnesia content cements, sorel cements, and combinations thereof. A cement composition is a heterogeneous fluid including water as the continuous phase of the slurry and the cement (and any other insoluble particles) as the dispersed phase.

A cement composition will develop gel strength and have an initial setting time and a setting time. A "gel" refers to a substance that does not easily flow and in which shearing stresses below a certain finite value fail to produce permanent deformation. The higher the gel strength, the more shear stress is required to move the gel. The compressive strength of a cement composition can be used to indicate whether the cement composition has initially set or set. As used herein, a cement composition is considered "initially set" when the cement composition develops a compressive strength of 50 psi (0.3 MPa) using the non-destructive compressive strength method at a temperature of 212° F. (100° C.) and a pressure of 3,000 psi (20 MPa). As used herein, the "initial setting time" is the difference in time between when the cement and any other ingredients are added to the water and when the composition is initially set. As used herein, the term "set," and all grammatical variations thereof, are intended to mean the process of becoming hard or solid. As used herein, the "setting time" is the difference in time between when the cement and any other ingredients are added to the water and when the composition has set at a specified temperature.

However, there are several disadvantages to cementing puddle jobs. If the cement develops a high enough gel strength or initially sets before the bottommost joint of liner is run into the wellbore, then the liner may not be capable of displacing some or all of the cement up into the annulus in order to cement the liner in the wellbore. In order to overcome these risks, operators must work very quickly to run the liner into the wellbore after the cement has been pumped or additives, such as set retarders, must be added to the cement before the cement is pumped in order to delay the gelation and initial setting time. However, operators may not be fast enough, or the additives may not be sufficient to allow the cement to be displaced up into the annulus to properly cement the liner in the wellbore. Accordingly, there exists a need for securing the liner in a wellbore that overcomes all of these problems.

It has been discovered that a settable resin can be used instead of cement in a puddle job. The resin is a liquid until contacted with an initiator. The initiator causes the resin to set. Contact with the initiator can be delayed, wherein the resin is in liquid form until contact with the initiator and no gelling occurs.

According to any of the embodiments, methods of securing a liner in a wellbore can include: installing a liner into the wellbore, wherein the liner comprises at least a first joint and a second joint; introducing a resin into the wellbore, wherein the resin is in liquid form prior to being contacted with an initiator; installing the second joint of liner into the wellbore after the resin has been introduced into the wellbore, wherein the first joint of liner displaces some or all of the resin up into at least a portion of an annulus located between a wellbore wall and an outside of the liner; and contacting the resin with the initiator during or after displacement of the liquid form of the resin, wherein contact with the initiator causes the resin to set.

Figure 2B:
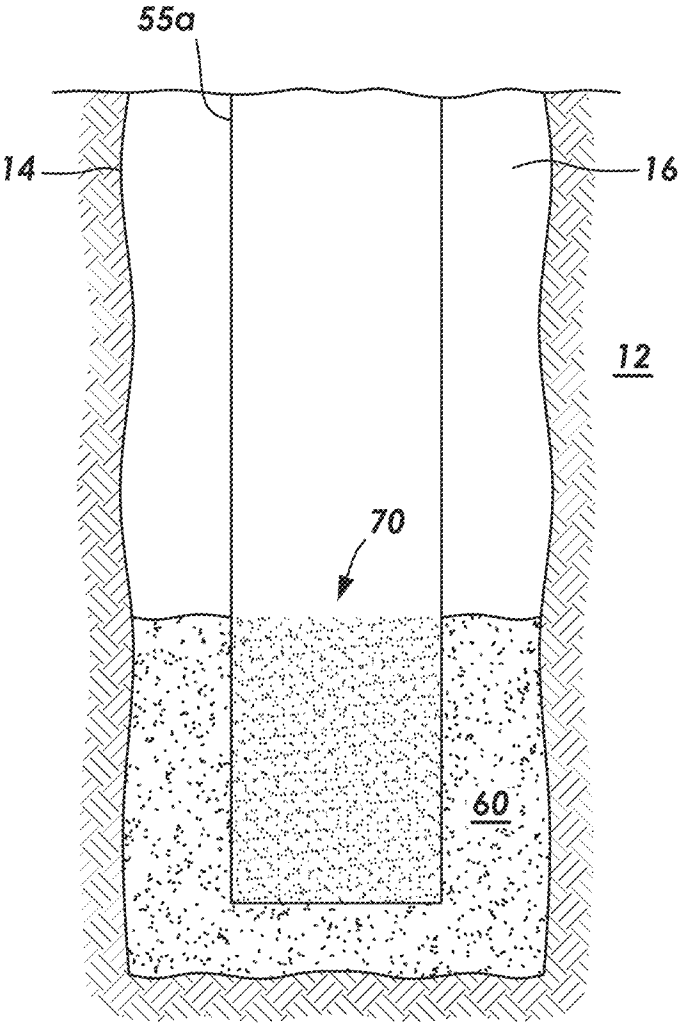
FIG. 2B is a schematic illustration of FIG. 2A showing displacement of the puddle of resin by the liner into an annulus of the wellbore according to certain embodiments.
Figure 2A:
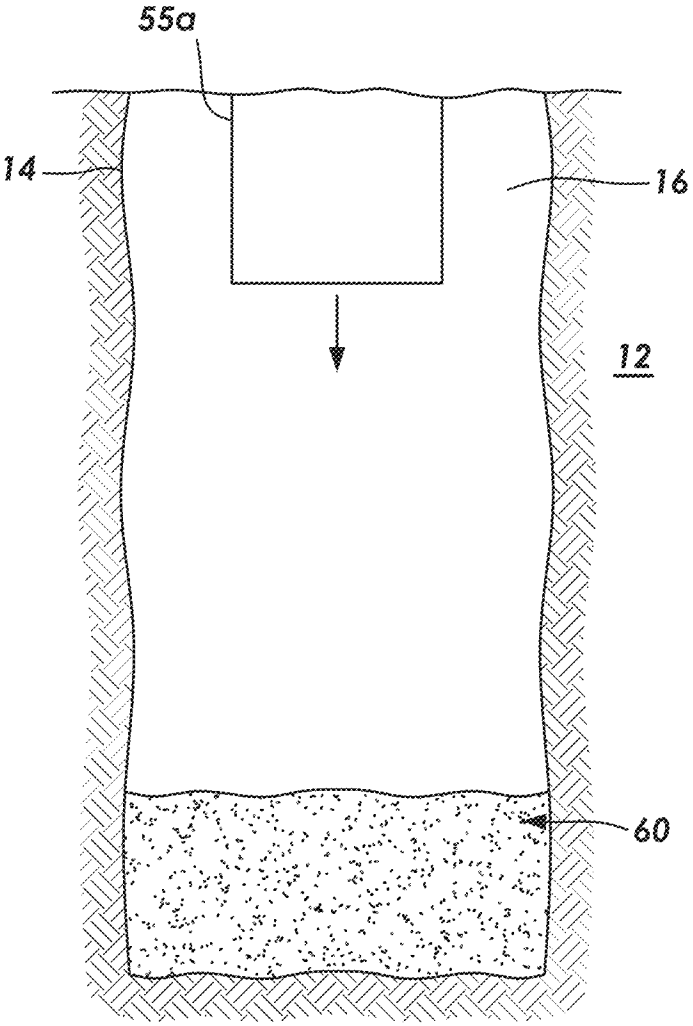
FIG. 2A is a schematic illustration showing a puddle of a settable resin at the bottom of the wellbore and the liner before being lowered into the puddle according to certain embodiments.

With reference to FIGS. 1 and 2A, which show a schematic illustration of a wellbore penetrating a subterranean formation 12 and having a wellbore wall 14. A liner 55 can include at least a first joint of liner 55*a* and a second joint of liner 55*b*. The liner 55 can include multiple other joints located between the first and second joints of liner. The liner 55 can be suspended from a surface casing 20 or an intermediate casing 35 via a liner hanger 45. The second joint of liner 55*b* can be joined to the first joint of liner 55*a* such that the first joint of liner 55*a* is farther away from the wellhead than the second joint of liner 55*b*.

As can be seen in FIGS. 2A and 2B, the methods can include introducing a resin 60 into the wellbore 10. The resin 60 is a settable resin. As used herein, the term "resin" means any settable resin and includes resin monomers that set via a polymerization reaction without the need to refer to resin monomers throughout. The resin can remain as a liquid until it is contacted with an initiator 70. The resin 60 in liquid form can be introduced into the wellbore 10 through the liner 55 or a separate tubing string, drill pipe, or coiled tubing (not shown) can be run into the liner and the resin can be introduced into the wellbore via the tubing string. The step of introducing can include using a pump to pump the resin into the wellbore. If a tubing string, drill pipe, or coiled tubing is used to introduce the resin, then the methods can further include removing the tubing string, drill pipe, or coiled tubing from the wellbore after introducing the resin.

Figure 3A:
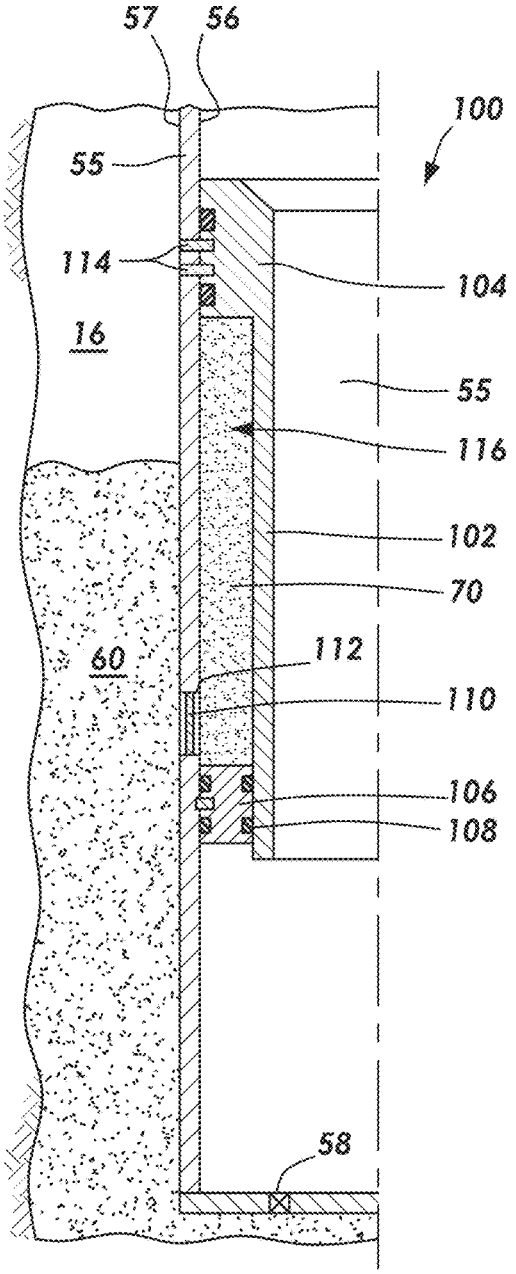
FIG. 3A is a cross-sectional view of an injection tool containing a liquid initiator being located on an inside of the liner prior to injecting the initiator into the annulus according to certain embodiments.
Figure 3B:
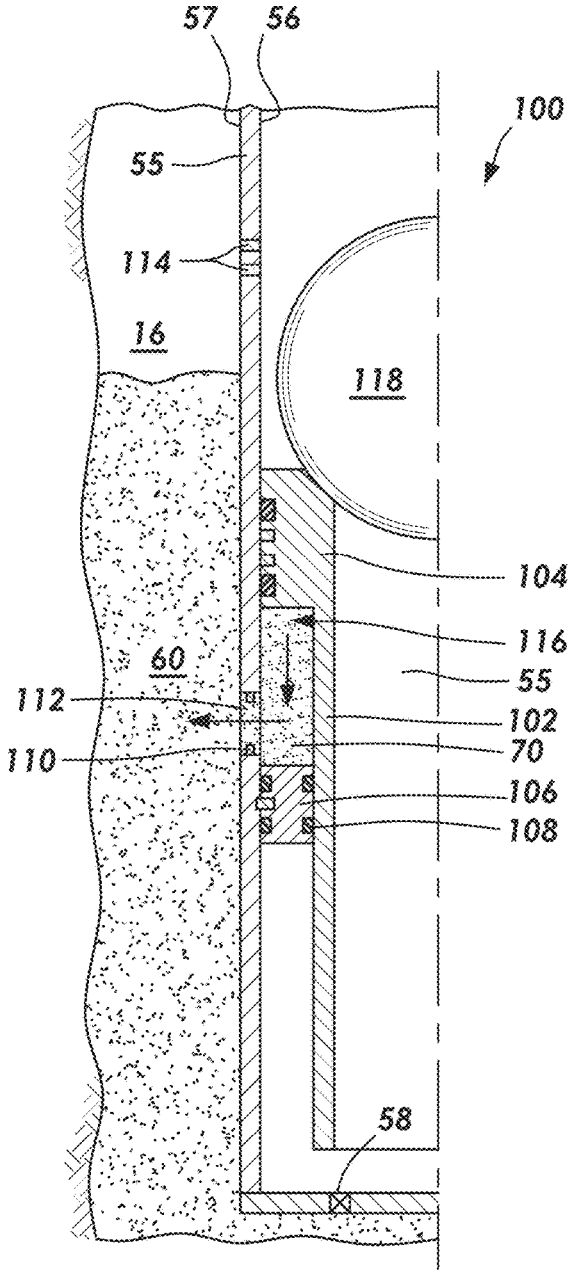
FIG. 3B is a cross-sectional view of the injection tool of FIG. 3A showing the initiator being injected into the annulus.
Figure 5:
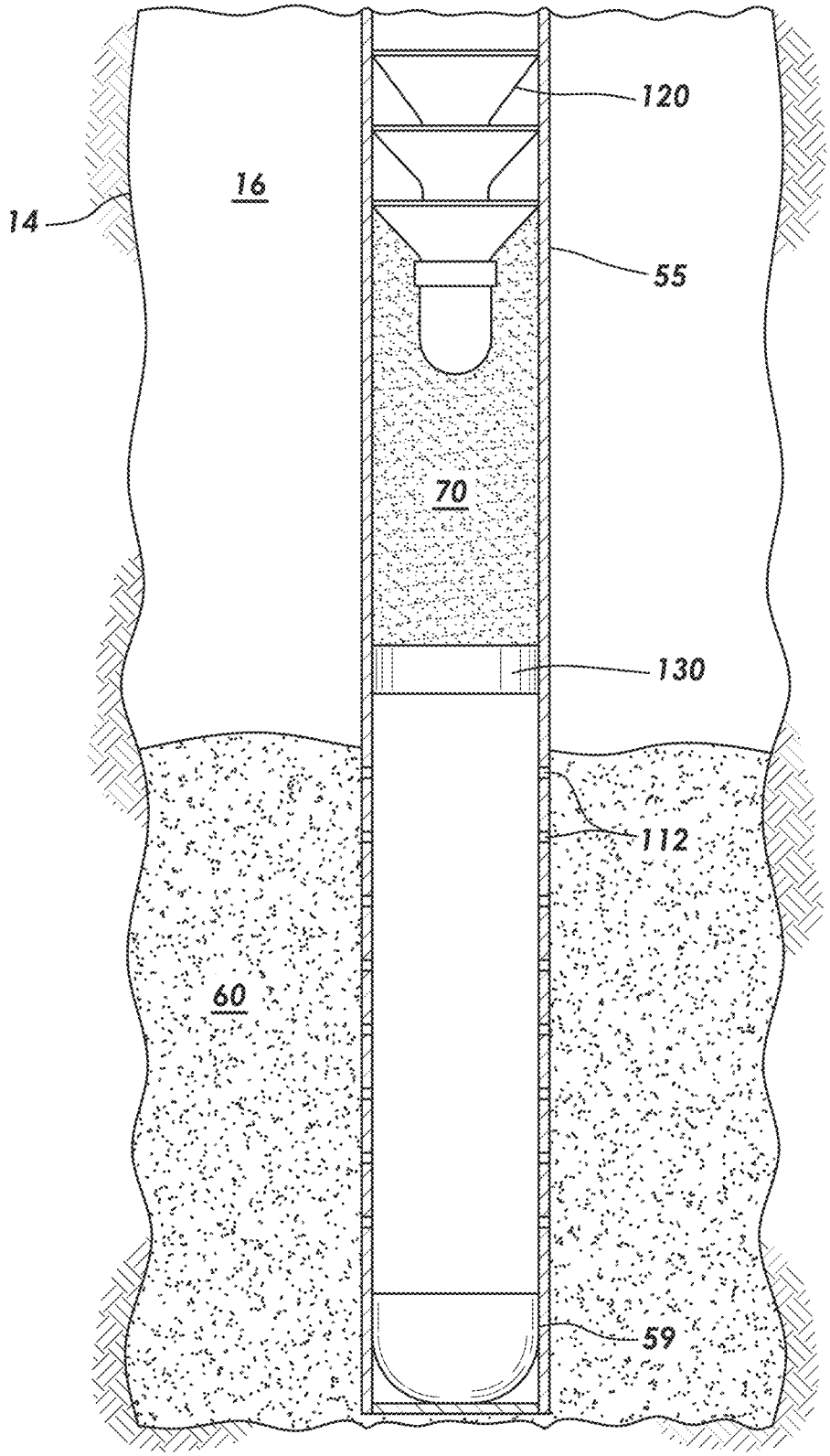
FIG. 5 is a cross-sectional view showing other embodiments for introducing the liquid initiator into the annulus.

As can be seen in FIG. 2B, after the resin 60 has been introduced, a second joint of liner 55*b* can be installed in the wellbore 10. The second joint of liner 55*b* will be located above the first joint of liner 55*a* and all liner 55 joints will be moved down within the wellbore. The first joint of liner 55*a* displaces some or all of the resin 60 in liquid form up into at least a portion of the annulus 16 located between the wellbore wall 14 and the outside of the liner 55, for example the first and second joints of liner 55*a*/55*b* and any additional intermediate liner joints. The first joint of liner 55*a* can include a fluid restrictor, for example a valve 58 as shown in FIG. 3B or float equipment or collar 59 as shown in FIG. 5, that prevents the resin 60 from entering the inside of the liner 55 during displacement of the resin 60 into the annulus 16. According to any of the embodiments, the resin 60 is displaced completely into the entirety of the annulus 16. According to any of the embodiments, a cement composition is not introduced into the wellbore to secure the liner within the wellbore, and the resin 60 and initiator 70 are used instead of cement.

The methods include contacting the resin 60 with an initiator 70 either during displacement or after the resin 60 has been displaced into the annulus 16, wherein contact with the initiator causes the resin to set. The resin can be any settable resin. The initiator 70 can be any type of initiator that causes the resin 60 to set. As used herein, the term "initiator" means any compound that is capable of causing the resin (i.e., resin monomers) to set (e.g., via a polymerization reaction) and includes initiators and activators as well as catalysts. By way of example, the initiator 70 can cause polymerization of the resin, which causes the liquid resin to set. The set resin can have desirable properties. According to any of the embodiments, the set resin can have a lower permeability, higher strain to failure ratios, and a higher compressive strength compared to a cement composition. According to any of the embodiments, the set resin possesses mechanical properties such that the set resin withstands the bottomhole temperature and pressure without failing. As used herein, the term "bottomhole" means the location in the wellbore where the resin is located. As used herein, "failing" means an undesirable loss of structural integrity that causes the set resin to no longer provide the intended function (e.g., cracks in the set resin occur that undesirably allow fluid to flow through the set resin, or thermal degradation or hydrolysis causes the set resin to revert to small molecules, which diffuse from the intended location in the annulus).

One of the many advantages of using the settable resin and initiator instead of a cement is that the resin remains in liquid form until contacted with the initiator. This allows the resin to remain in liquid form during placement of the puddle of resin into the wellbore, and as the liner displaces the liquid resin up into the annulus. According to any of the embodiments, as the first joint of liner 55*a* is being pushed through the puddle of resin 60, all of the liner 55 joints or at least the first joint of liner 55*a* can be rotated. This rotation can cause mixing of the resin in liquid form with the initiator. A significant advantage to rotation is that an operator at the surface can gauge the torque during rotation. As the resin begins to set, the viscosity of the resin/initiator mixture increases, which increases the resistance of the rotation. Once the torque reaches a predetermined level, then the operator can confirm that the puddle job has been performed correctly and would stop rotation of the liner joint(s).

According to any of the embodiments, the initiator 70 can be in a solid form. As shown in FIG. 2B, the solid initiator 70 can be coated onto the outside of a portion of the liner 55. The solid initiator 70 can be coated onto all or a portion of the outside of the first joint of liner 55*a*, the second joint of liner 55*b*, intermediary joints of liner 55, and any combination thereof. The concentration of the initiator 70 can vary and can be selected such that a sufficient amount of the initiator 70 contacts the resin 60 to ensure all or a majority of the resin completely sets in the annulus 16. By way of example, the location(s) of the coating, the thickness of the coating, the total area that is coated, and the specific liner 55 joints that are coated can be selected to ensure that the initiator 70 makes contact with the liquid resin 60 in the annulus 16 such that the resin sets. According to any of the embodiments, the ratio of initiator 70 to resin 60 is 1:1 to 1:1000.

Figure 4:
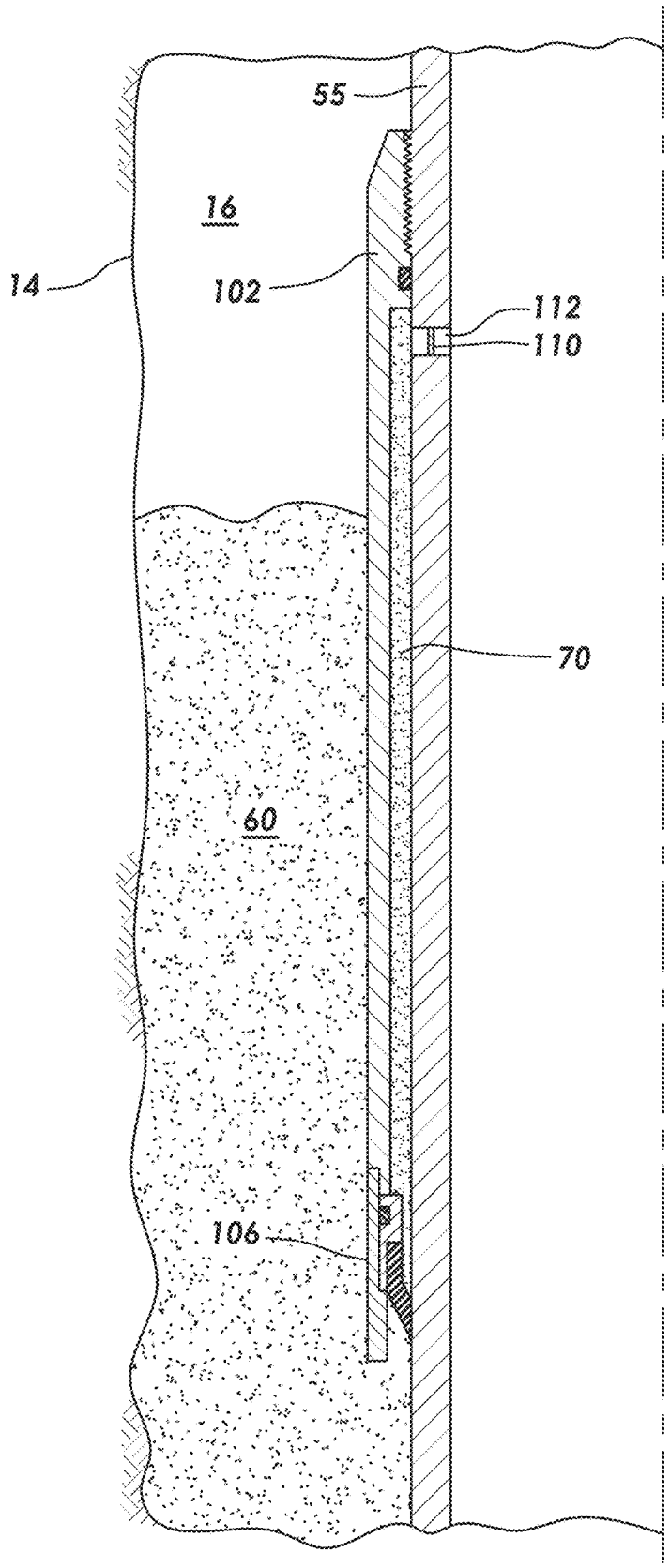
FIG. 4 is a cross-sectional view of an injection tool containing a liquid initiator being located on an outside of the liner prior to injecting the initiator into the annulus according to certain other embodiments.

The initiator 70 can also be in a liquid form. As shown in FIGS. 3A and 3B, an injection tool 100 for dispensing a liquid initiator 70 into the annulus 16 to contact the liquid resin 60 can be located on an inside of a joint of the liner 55; and as shown in FIG. 4, the injection tool 100 can be located on an outside of a joint of liner 55. There can also be more than one injection tool 100 that are located on different joints of the liner 55, for example a first injection tool 100 on the first joint of liner 55*a* and a second injection tool 100 on the second joint of liner 55*b*. The use of more than one injection tool 100 can be beneficial, particularly when the annulus 16 that includes the displaced resin 60 has a large volume of resin (e.g., the length of the annulus containing the resin is greater than 50 feet (15.2 meters)), to ensure that at least 60% for example of the entire volume of resin 60 sets. An advantage to using an injection tool is that the initiator 70 can be injected slowly into the resin 60 as the liner is lowered from the one or more injection tools 100. The injection tool 100 can be attached to the inside or outside of the liner 55 joint(s) via threads, welding, spot welding, or an adhesive such as an epoxy, for example.

The injection tool 100 can include a housing 102. The liquid initiator 70 can be contained within a cavity 116 located within portion of the housing 102 on the inside of the liner joint. The dimensions, and therefore the total volume of the cavity 116 can be selected such that a desired volume of initiator 70 can be contained within the cavity 116. The desired volume can be dependent on the volume of resin 60 located within the annulus 16. The desired volume can be selected such that a desired ratio (e.g., 10:1 or greater) of initiator to resin is achieved. The injection tool 100 can include a piston/seat 104 located at the top of the injection tool 100 and retained in place via a frangible device 114, such as shear pins. The frangible device 114 can have a force rating in which when a force above the force rating is applied to the piston/seat 104, then the frangible device 114 shears and allows movement of the housing 102 and the piston/seat 104 to move down.

The liner 55 joint that includes the injection tool 100 can include a port 112 that spans completely through the liner joint from an inner diameter of liner 56 to the outer diameter of liner 57 and is located within the cavity 116 that contains the initiator 70. The opening of the port 112 can be a variety of dimensions and shapes. By way of an example, the diameter of the opening can range from 0.1 inch "in." to 1 in (0.254 to 2.54 centimeters). The diameter of the opening can be selected, in part, based on the desired fluid volume and/or flow rate of the initiator 70 through the port 112. The opening can be any shape, for example, circular, square, rectangular, or other geometric shapes. There can also be more than one port 112 located in a variety of spacing distances from each other within the cavity 116 that contains the initiator 70. Additional flow ports may be beneficial as a way to ensure the desired volume of resin 60 is contacted with the initiator 70 to ensure proper setting of the resin is achieved. A port plug 110, for example a rupture disk, can be located within the port 112. The port plug 110 can have a force rating such that when a pressure above the force rating is applied to the port plug, then the port plug can rupture; thereby allowing the initiator 70 to flow from the injection tool 100, through the port 112, and into the annulus 16 to contact the resin 60. The force rating for the port plug 110 can be in a range of 500 to 2,000 pounds force per square inch (psi) (3.45 to 13.8 megapascals (MPa), for example. If there is more than one injection tool 100, then the force rating of the two or more port plugs 110 can be the same or different.

The injection tool 100 can include a retainer 106 that is located below the port 112 at the lower end of the cavity 116 containing the initiator 70. The retainer 106 can be permanently fixed to the inside of the liner 55 joint such that movement of the housing 102 and piston/seat 104 does not cause movement of the retainer 106. One or more seals 108, such as O-rings, can be located between the outsides of the retainer 106 and the ID of the liner 56 and/or the inside of the housing 102. The seals 108 can prevent the initiator 70 from leaking past the retainer 106 and into the liner 55.

As can be seen in FIG. 3B, a ball or plug 118 can be dropped to engage with a top of the piston/seat 104. Pressure can be applied from the top of the ball or plug 118 until the pressure becomes greater than or equal to the force rating of the frangible device 114. After the frangible device 114 shears and with continued pressure, the piston/seat 104 and housing 102 will shift down, which causes pressure within the cavity 116 to increase. When the pressure within the cavity 116 becomes greater than or equal to the force rating of the port plug 110, then the port plug 110 ruptures and allows the initiator 70 to be injected into the annulus 16 to contact the resin 60 via the port 112.

Turning now to FIG. 4, which shows the injection tool 100 located on the outside of the liner 55, the cavity 116 can be formed from the housing 102 and a retainer 106 to contain the liquid initiator 70. The port 112 can span from an inside of the housing completely through the housing to provide a fluid flow path into the annulus 16. The retainer 106 can include an internal check seal. As with FIGS. 3A and 3B, a ball or plug can be dropped to engage with the piston/seat 104, which can cause the frangible device 114 to shear and move the piston/seat 104 down. As pressure builds up within the cavity 116, then the port plug 110 can rupture and the initiator 70 can be injected through the port 112 of the housing 102 and into the annulus 16. The pressure within the cavity 116 can also cause the initiator 70 to flow past the check seal.

FIG. 5 shows other embodiments for injecting or dispensing a liquid initiator 70 into the annulus 16 to contact the resin 60. The liner 55 can include a flotation sub 130, for example a glass flotation sub. The initiator 70 can be contained within the liner 55 on top of the flotation sub 130. Multiple flow ports 112 can span through the liner 55 and located below the flotation sub 130. The total number of flow port 112 can be selected to evenly contact and mix the initiator 70 with the resin 60 either afterwards or simultaneously as the resin 60 is being displaced by the first joint of liner 55*a*. A float shoe 59 can be located at the very bottom of the liner 55 joint such that fluid cannot flow from the inside of the liner 55 and out the bottom end of the liner or from outside the liner and up through the bottom to the inside of the liner. In this manner, fluid flow may only occur through the flow ports 112.

In order to inject the initiator 70 into the annulus 16 to contact the resin 60, a plug 120 can be pumped inside the liner 55, which forces the initiator 70 down towards the flotation sub 130. When the pressure is increased above the operating pressure of the flotation sub 130, the flotation sub 130 can burst, which allows the initiator 70 to flow into the joint of liner 55 containing the flow ports 112. The plug 120 can continue to be pushed downwardly towards the float shoe 59 as the liner 55 is lowered into the puddle of resin 60. This causes the resin 60 to be displaced up into the annulus 16 and allows the initiator 70 to contact and mix with the resin 60 to cause the resin to set. The rate at which the plug 120 is pushed down the inside of the liner 55 after the flotation sub 130 has burst can be controlled such that there is an even and steady injection of the initiator 70 into the resin 60.

As discussed above, when the resin is contacted with the initiator, the initiator causes the resin to set. The setting time of the resin can be in a range, for example from 10 minutes to 5 hours, from when the resin is contacted with the initiator. In this manner, the viscosity of the resin/initiator mixture can gradually increase so the mixture is still in a fluid form to ensure the mixture is fully displaced at the desired location within the annulus before becoming completely set. This significant advantage may not be possible when using a cement composition or only possible when cement set retarders are added to the cement. This is because a cement composition is mixed at the surface and then has to be pumped downhole and then the liner has to displace the cement, and the clock starts ticking on the cement developing gel strength and the setting time as soon as the cement is mixed with water. Whereas the resin remains in a liquid form until it is contacted with the initiator. This advantageously delays the setting of the resin at least until after the resin has been introduced into the wellbore and possibly until after the resin has been displaced by the liner. After the resin has set, a variety of other oil and gas operations can be performed. As also mentioned above, another significant advantage is that the set resin can possess superior properties compared to a set cement composition.

An embodiment of the present disclosure is a method of securing a liner in a wellbore comprising: installing a liner into the wellbore, wherein the liner comprises at least a first joint and a second joint; introducing a resin into the wellbore, wherein the resin is in liquid form prior to being contacted with an initiator; installing the second joint of liner into the wellbore after the resin has been introduced into the wellbore, wherein the first joint of liner displaces some or all of the resin up into at least a portion of an annulus located between a wellbore wall and an outside of the liner; and contacting the resin with the initiator during or after displacement of the liquid form of the resin, wherein contact with the initiator causes the resin to set. Optionally, the resin is a settable resin. Optionally, the first joint of liner comprises a fluid restrictor that prevents the resin from entering the inside of the liner during displacement of the resin into the annulus. Optionally, the method further comprises rotating at least the first joint of liner as the first joint of liner is displacing the resin, at least the first joint of liner is rotated. Optionally, the initiator is in a solid form. Optionally, the initiator in solid form is coated onto the outside of a portion of the liner. Optionally, the initiator is in a liquid form. Optionally, the method further comprises an injection tool for dispensing the liquid form of the initiator into the annulus located on an inside of a joint of the liner or located on an outside of a joint of liner. Optionally, the method further comprises one or more additional injection tools located on different joints of the liner. Optionally, the injection tool comprises a housing, a cavity located within a portion of the housing, and wherein the liquid form of the initiator is contained within the cavity. Optionally, the cavity has a volume, and wherein the volume of the cavity is selected to provide a ratio of initiator to resin from 1:1 to 1:1000. Optionally, the injection tool further comprises a piston and seat located at a top of the injection tool that is retained in place to the liner via a frangible device. Optionally, the method further comprises a port located within the cavity that spans completely through the liner or completely through the injection tool housing and a port plug located within the port, wherein the port provides a fluid flow path for the initiator from the cavity to the annulus. Optionally, the injection tool further comprises a retainer located below the port at a lower end of the cavity, and wherein the retainer is permanently fixed to the inside or outside of the liner such that movement of the housing and piston and seat does not cause movement of the retainer. Optionally, the method further comprises dropping a ball or plug into the liner to engage with a top of the seat, and increasing pressure above the ball or plug to a pressure greater than or equal to a force pressure of the frangible device, wherein the increase in pressure causes the frangible device to shear and the piston and seat and housing to move down. Optionally, downward movement of the housing causes the pressure within the cavity to increase, and wherein when the pressure within the cavity becomes greater than or equal to a force rating of the port plug, then the port plug ruptures, and the initiator is caused to be injected into the annulus via the port. Optionally, the liner further comprises a flotation sub having a force rating. Optionally, the method further comprises multiple flow ports located below the flotation sub and extending through the liner to the annulus. Optionally, the liquid form of the initiator is located within the liner above the flotation sub. Optionally, the method further comprises: dropping or pumping a plug into the liner above the liquid form of the initiator; increasing pressure on the flotation sub to a pressure above the force rating of the flotation sub, wherein the increase in pressure causes the flotation sub to burst; and causing the plug to continue to move towards a bottom of the liner, wherein the liquid initiator is forced into the annulus via the multiple flow ports.

Therefore, the apparatus, methods, and systems of the present disclosure are well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present disclosure.

As used herein, the words "comprise," "have," "include," and all grammatical variations thereof are each intended to have an open, non-limiting meaning that does not exclude additional elements or steps. While compositions, systems, and methods are described in terms of "comprising," "containing," or "including" various components or steps, the compositions, systems, and methods also can "consist essentially of" or "consist of" the various components and steps. It should also be understood that, as used herein, "first," "second," and "third," are assigned arbitrarily and are merely intended to differentiate between two or more liner joints, injection tools, etc., as the case may be, and does not indicate any sequence. Furthermore, it is to be understood that the mere use of the word "first" does not require that there be any "second," and the mere use of the word "second" does not require that there be any "third," etc.

Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A method of securing a liner in a wellbore comprising:

installing a liner into the wellbore, wherein the liner comprises at least a first joint and a second joint;

introducing a resin into the wellbore, wherein the resin is in liquid form after introduction into the wellbore and prior to being contacted with an initiator;

installing the second joint of liner into the wellbore after the liquid resin has been introduced into the wellbore, wherein the first joint of liner displaces some or all of the liquid resin up into at least a portion of an annulus located between a wellbore wall and an outside of the liner; and contacting the liquid resin with the initiator during or after displacement of the liquid resin by the first joint of liner, wherein contact with the initiator causes the resin to set, wherein:

the initiator is in a solid form and is coated onto an outside of a portion of the liner; or the initiator is in liquid form and further comprising an injection tool for dispensing the liquid initiator into the annulus.

2. The method according to claim 1, wherein the resin is a settable resin.

3. The method according to claim 1, wherein the first joint of liner comprises a fluid restrictor that prevents the resin from entering the inside of the liner during displacement of the resin into the annulus.

4. The method according to claim 1, further comprising rotating at least the first joint of liner as the first joint of liner is displacing the resin.

5. The method according to claim 4, wherein rotation of the at least the first joint of liner mixes the resin with the initiator, wherein the viscosity of the resin and initiator mixture increases, and further comprising monitoring torque during the rotation.

6. The method according to claim 1, wherein the initiator is in liquid form, and wherein the injection tool is located on an inside of a joint of the liner or located on an outside of a joint of liner.

7. The method according to claim 6, further comprising one or more additional injection tools located on different joints of the liner.

8. The method according to claim 6, wherein the injection tool comprises a housing, a cavity located within a portion of the housing, and wherein the liquid form of the initiator is contained within the cavity.

9. The method according to claim 8, wherein the cavity has a volume, and wherein the volume of the cavity is selected to provide a ratio of initiator to resin from 1:1 to 1:1000.

10. The method according to claim 8, wherein the injection tool further comprises a piston and seat located at a top of the injection tool that is retained in place to the liner via a frangible device.

11. The method according to claim 10, further comprising a port located within the cavity that spans completely through the liner or completely through the injection tool housing and a port plug located within the port, wherein the port provides a fluid flow path for the initiator from the cavity to the annulus.

12. The method according to claim 11, wherein the injection tool further comprises a retainer located below the port at a lower end of the cavity, and wherein the retainer is permanently fixed to the inside or outside of the liner such that movement of the housing and piston and seat does not cause movement of the retainer.

13. The method according to claim 12, further comprising:

dropping a ball or plug into the liner to engage with a top of the seat, and increasing pressure above the ball or plug to a pressure greater than or equal to a force pressure of the frangible device, wherein the increase in pressure causes the frangible device to shear and the piston and seat and housing to move down.

14. The method according to claim 13, wherein downward movement of the housing causes the pressure within the cavity to increase, and wherein when the pressure within the cavity becomes greater than or equal to a force rating of the port plug, then the port plug ruptures, and the initiator is caused to be injected into the annulus via the port.

15. The method according to claim 1, wherein the initiator is in liquid form, and wherein the liner further comprises a flotation sub having a force rating.

16. The method according to claim 15, further comprising multiple flow ports located below the flotation sub and extending through the liner to the annulus.

17. The method according to claim 16, wherein the liquid form of the initiator is located within the liner above the flotation sub.

18. The method according to claim 17, further comprising:

dropping or pumping a plug into the liner above the liquid form of the initiator;

increasing pressure on the flotation sub to a pressure above the force rating of the flotation sub, wherein the increase in pressure causes the flotation sub to burst; and causing the plug to continue to move towards a bottom of the liner, wherein the liquid initiator is forced into the annulus via the multiple flow ports.

19. The method according to claim 1, wherein the initiator is in solid form, and wherein the solid initiator is coated onto an outside of the first joint of liner and the second joint of liner.

20. The method according to claim 1, wherein the initiator is in solid form, and wherein the ratio of initiator to resin is in a range of 1:1 to 1:1000.

* * * * *